US009951951B2

(12) United States Patent
Lovascio et al.

(10) Patent No.: US 9,951,951 B2
(45) Date of Patent: Apr. 24, 2018

(54) APPARATUS FOR CONTROLLING AND ADJUSTING THE COMBUSTION IN A FUEL GAS BURNER

(71) Applicant: Gas Point S.r.l., Brescello (IT)

(72) Inventors: Nicola Lovascio, Sant'ilario D'enza (IT); Raffaello Rastelli, Sorbolo (IT); Claudio Zatti, Sorbolo (IT)

(73) Assignee: GAS POINT S.R.L., Brescello (IT)

( * ) Notice: Subject to any disclaimer, the term of this patent is extended or adjusted under 35 U.S.C. 154(b) by 0 days.

(21) Appl. No.: 14/436,821

(22) PCT Filed: Oct. 17, 2013

(86) PCT No.: PCT/IB2013/059431
§ 371 (c)(1),
(2) Date: Apr. 17, 2015

(87) PCT Pub. No.: WO2014/060991
PCT Pub. Date: Apr. 24, 2014

(65) Prior Publication Data

US 2015/0247639 A1 Sep. 3, 2015

(30) Foreign Application Priority Data

Oct. 17, 2012 (IT) ..... BO2012A0568

(51) Int. Cl.
*F23N 1/02* (2006.01)
*F23N 1/00* (2006.01)
(Continued)

(52) U.S. Cl.
CPC ..... *F23N 1/022* (2013.01); *F23N 1/002* (2013.01); *F23N 5/022* (2013.01); *F23N 5/102* (2013.01); *F23N 5/143* (2013.01); *F23N 2025/16* (2013.01)

(58) Field of Classification Search
CPC ..... F23N 1/002; F23N 1/022
(Continued)

(56) References Cited

U.S. PATENT DOCUMENTS 5,857,319 A * 1/1999 Sattelmayer ..... F23R 3/286 431/8
5,989,020 A * 11/1999 Glass ..... F24H 9/0026 122/18.4
2011/0033808 A1 2/2011 Geiger et al.

FOREIGN PATENT DOCUMENTS

DE 3918855 8/1990
DE 197345574 2/1999
(Continued)

OTHER PUBLICATIONS

Translation of Lamthien.*
(Continued)

*Primary Examiner* — Avinash Savani
*Assistant Examiner* — Aaron Heyamoto
(74) *Attorney, Agent, or Firm* — McCracken & Gillen LLC

(57) ABSTRACT

An apparatus for adjusting and controlling the combustion in a fuel gas burner. The apparatus comprises the following mutually integrated components: a comburent gas/fuel gas mixing pipe provided with a Venturi mixer in correspondence of which a fuel gas supply duct opens; means for adjusting the flow rate of fuel gas; a fan, at least partially housed in said mixing pipe; a burner arranged downstream of said fan; a safety system based upon the detection of the flame present in said burner; and an electronic control unit of devices belonging to the apparatus. The apparatus is characterized in that it further comprises: a temperature probe arranged on the inner surface of the burner; a valve for adjusting the fuel gas flow rate in the duct; said valve belonging to said control means and being mechanically
(Continued)

controlled by an actuator; and an electronic card, electronically connected to said probe, to said fan and to said actuator.

8 Claims, 5 Drawing Sheets

(51) Int. Cl.
*F23N 5/10* (2006.01)
*F23N 5/14* (2006.01)
*F23N 5/02* (2006.01)

(58) Field of Classification Search
USPC ..... 431/12, 75, 2
See application file for complete search history.

(56) References Cited

FOREIGN PATENT DOCUMENTS

| | | |
|---|---|---|
| EP | 1811230 | 7/2007 |
| GB | 2270748 | 3/1994 |
| WO | WO 2009/133451 | 11/2009 |

OTHER PUBLICATIONS

International Search Report and Written Opinion of the International Search Authority dated Mar. 27, 2014, for International Application PCT/IB2013/059431, filed Oct. 17, 2013, Applicant, Gas Point S.r.l. (12 pages).

* cited by examiner

APPARATUS FOR CONTROLLING AND ADJUSTING THE COMBUSTION IN A FUEL GAS BURNER

TECHNICAL FIELD

The present invention concerns an apparatus for controlling and adjusting the combustion in a fuel gas burner, which is able to maintain optimal values of the air/gas ratio in order to obtain optimal emissions of carbon dioxide (CO2), carbon oxide (CO) and nitrogen oxides (NO and NO2), regardless of the kind of gas used and of the power supplied by the burner.

In particular, the present invention finds an advantageous, but not exclusive, application in premix burners, to which the following description will make explicit reference without thereby losing in generality.

In Europe, gas-fired condensing boilers are becoming increasingly popular.

They are characterized by a high yield and by a low emission of pollutants, resulting from the use of premix burners.

However, a low emission of pollutants depends on the purity of the gases.

Fuel gases presently available in the market are classified into 3 families:

- the first family is formed by gases having a density lower than air and a low calorific value, such as city gas;
- the second family is formed by gases having a density lower than air and a high calorific power, such as natural gas, methane;
- the third family is formed by gases having a density higher than air and a higher calorific power, such as propane and butane.

The fuel gases of the first family will not be further discussed, since they are poorly used and scarcely widespread.

The reference gas of the second family is pure natural gas.

Actually, the natural gas distributed through the network is never pure methane (G20), but is always a mixture mainly containing methane and, in relatively low percentages, other gases such as nitrogen (N2), hydrogen (H2), propane (C3H8).

Analogously, the liquid gas belonging to the third family and distributed by means of tanks is never pure propane or pure butane, but is a mixture of propane (C3H8), butane (C4H10), propylene (C3H6).

The presence of several gaseous components in the distributed gases forces the manufacturers of gas appliances to make products with burners that are able to operate regularly (namely, never going off nor entering into the atmosphere excessive amounts of polluting gases), both with reference gases and with other gases.

In order to avoid the risk of going off, the burners are operated with gas-rich air/gas mixtures.

Each gas is characterized by a reference parameter, the so called "Wobbe index (Wi)", sufficient to define the amount of energy that the fuel is able to supply to the burner by passing through a fixed geometry gas supply circuit.

BACKGROUND ART

As already known from the state of the art, in all applications the gas arrives to the burner after passing through devices (valves, nozzles and so on), all having in common, from the functional point of view, a calibrated orifice.

With a calibrated orifice having the same size, the gases having a high Wi can supply more thermal energy; the opposite is true for gases having a low Wi.

Each gas is further characterized by a higher or lower propensity to correct combustion.

There are gases having more difficulties in reaching a perfect and complete combustion with a higher emission of pollutants CO and CO2; they are the so called "incomplete combustion limit gases".

They are always characterized by the highest Wi of their category.

Moreover, there are gases having a higher flame propagation rate and therefore a higher propensity to backfire inside the burner. They are the so called "backfire gases".

These gases are characterized by having a high Wi which is however lower than the highest of their category.

Finally, there are gases having a lower flame propagation rate and therefore a higher propensity to a flame detachment from the burner; they are the so called "flame detachment gases".

These gases are characterized by the lowest Wi of their category.

In order to facilitate the correct matching between gases distributed in the market and gas appliances, in Europe gases have been classified according to homogeneous groups, as well as according to families (as previously mentioned).

Within the natural gas family, in fact, groups H, L and E have been identified.

Group H comprises gases having a Wi comprised between 41.01 and 49.6 $MJ/m^3$ and has G20 methane as reference gas.

Group L comprises gases having a Wi comprised between 35.17 and 40.52 $MJ/m^3$ and has G25 as reference gas.

Group E comprises gases having a Wi comprised between 36.82 and 49.6 $MJ/m^3$ and has G20 methane as reference gas.

Within the liquid gas family (commonly referred to as GPL) groups B and P have been identified.

Group B comprises gases having a Wi comprised between 68.14 and 80.58 $MJ/m^3$ and has G30 butane as reference gas.

Group P comprises gases having a Wi comprised between 68.14 and 70.69 $MJ/m^3$ and has G31 propane as reference gas.

By reading the various Wi related to the first gas family, namely the most widespread, it is clear that group E contains gases with the broadest Wi spectrum.

As a consequence, it is decidedly more complex to manufacture products provided with burners suitable to this gas group, or which are indifferently suitable to gases of the groups H and L.

On the other hand, products which are suitable to this kind of gases are the most valued, because they can be interchangeably installed almost all over Europe without limitation.

Unfortunately, in order to allow the burners to work correctly and without flame detachment with "limit" gases, having a lower Wi, the burners must work with reference gases having a particularly low air/gas ratio, namely with particularly gas-rich mixtures, all at the expense of combustion hygiene.

This explains the constant search for solutions designed for making burners work with gases having the broadest Wi difference.

From the technical point of view, the way to get an excellent combustion has long been known.

In fact, it is well known in the art that to get an excellent combustion it must take place with a mixture having an amount of excess air comprised between 30% and 35%.

As it is also known, the air/gas ratio in a fuel mixture is synthetically indicated with the parameter λ.

It represents the ratio between the amount of air used in the combustion process and the amount of air stoichiometrically required.

For methane combustion, for instance, the amount of air stoichiometrically required corresponds to 9.52 $m^3$ for each $m^3$ of methane, corresponding to $\lambda=1$.

Actually, if the combustion took place in the presence of the stoichiometrical amount of air only, it would have a very high production of unburned by-products, and in particular of CO.

Therefore, combustion always takes place in the presence of an amount of excess air, then with $\lambda>1$.

For premix burners such optimal amount of excess air, as already stated, has been experimentally identified in a value comprised between 30% and 35%; namely a λ comprised between 1.30 and 1.35.

It has been experimentally confirmed that such optimal value is suitable to any kind of gas belonging to the different groups of the two available families; therefore, besides being suitable to reference gases, it is also suitable to limit gases.

However, traditional air/gas systems cannot distinguish the kind of gas they are supplied with; moreover, if they worked with the optimal λ value corresponding to 1.33, by inserting limit gases having a lower Wi they would constantly risk to get blocked because of a flame detachment.

As a consequence, a traditional air/gas system is operated with reference gas G20 at λ values corresponding to 1.25.

By inserting the incomplete combustion limit gas G21, the λ value becomes 1.17, with a subsequent high emission of CO and NOx; by inserting the flame detachment limit gas G231, the λ value becomes 1.50 with a subsequent risk of flame detachments and subsequent burner block thanks to the safety device.

This long introduction serves to understand the protracted efforts made to find solutions which would allow the burners to work with a constant air/gas ratio regardless of the kind of gas.

In order to improve the understanding of the present invention, reference is made to an embodiment of an apparatus for adjusting and controlling the combustion according to the prior art; said known embodiment is showed in FIG. 1.

The apparatus 100 of FIG. 1 belonging to the prior art comprises:

- a Venturi mixer 15, placed in a mixing pipe 10, in which a fuel gas supply duct 22 flows; therefore in this case the mixing area (ZM) is in correspondence of the Venturi mixer 15; and
- a pneumatic gas valve 20 (fed by gas through a supply duct 21), feeding gas in an amount corresponding to the depression generated downstream of the valve by the Venturi mixer 15 and, therefore, corresponding to the amount of air passing through it.

The gas valve 20, the so called "pneumatic valve", is a device providing for both adjustment and safety.

It can be schematically showed as a device inside which two shutters are provided.

The first shutter performs the safety function, whereas the second shutter provides for the adjustment of the gas flow.

The first shutter is connected to the safety system arranged in an electronic control unit (CE) and based on the detection of the presence of the flame.

The second shutter is connected to the adjustment system operated by the depression generated by the Venturi mixer 15.

The apparatus 100 further comprises:

- a fan 30 whose impeller is housed in the mixing pipe 10 and is arranged downstream of the gas/air mixing area (ZM);
- a burner 40, arranged downstream of the fan 30, preferably being of the perforated duct kind; in other words, the burner 40 looks like a metal pipe closed at the bottom and provided with a plurality of through holes from which the air/gas mixture comes out, said mixture being ignited, in a known way, by an electric device (not shown). It is thus created a flame (FLM), substantially evenly distributed over the entire outer cylindrical surface of the burner 40; and
- a safety system based on the flame (FLM) detection and developed by means of a safety spark plug 50 whose electrode 51 is under tension with respect to the metal mass of the burner 40; and it is known that in the presence of the flame (FLM) there is the passage of an electric current (very small and rectified, since the flame acts as a rectifier of alternating current) between the electrode 51 and the metal mass of the burner 40; this current is detected by means of known systems by the electronic control unit (CE) which, at the same time, generates the voltage difference required for the passage of the current.

As also shown in FIG. 1, the electronic control unit (CE) is electrically connected to the gas valve 20, to the fan 30 and to the safety spark plug 50.

Said apparatus 100 is characterized by the following features:

- the fan 30 determines the air flow required for the perfect and complete combustion of the gas;
- the gas valve 20, operated by the Venturi mixer 15, supplies gas in an amount proportional to the air flow;
- the electronic control unit (CE) constantly verifies the presence of the flame (FLM) on the burner by means of the spark plug 50.

However, the apparatus 100 of the prior art still has the aforesaid drawback related to the inability to adapt to different kinds of gas.

By varying the Wobbe index of the incoming gas, the air/gas ratio values in the burner significantly vary too, with a negative impact on the emission of pollutants CO and NOx and sometimes with problems of flame detachment due to excess air and a consequent block of the gas flow through the gas valve.

DISCLOSURE OF INVENTION

Therefore, it is a main object of the present invention to provide an apparatus with which premix burners can work with an optimal combustion (namely with a minimum emission of pollutants and a maximum guarantee of burner ignition) by varying the power in the whole working range, using any kind of gas belonging to the same family, with the maximum safety and reliability.

According to the present invention, therefore, it is realized an apparatus for adjusting and controlling the combustion according to what claimed in Claim 1, or in any Claim directly or indirectly dependent on Claim 1.

Moreover, always according to the present invention, it is provided an auxiliary kit for an apparatus for adjusting and controlling the combustion in a fuel gas burner according to what claimed in Claim 10.

A further object of the present invention is a method for adjusting and controlling the combustion in a fuel gas burner according to what claimed in Claim 12.

BRIEF DESCRIPTION OF THE DRAWINGS

For a better understanding of the present invention it is now described a preferred embodiment, purely by way of non limitative example and with a reference to the accompanying drawings, wherein.

BEST MODE FOR CARRYING OUT THE INVENTION

Figure 2:
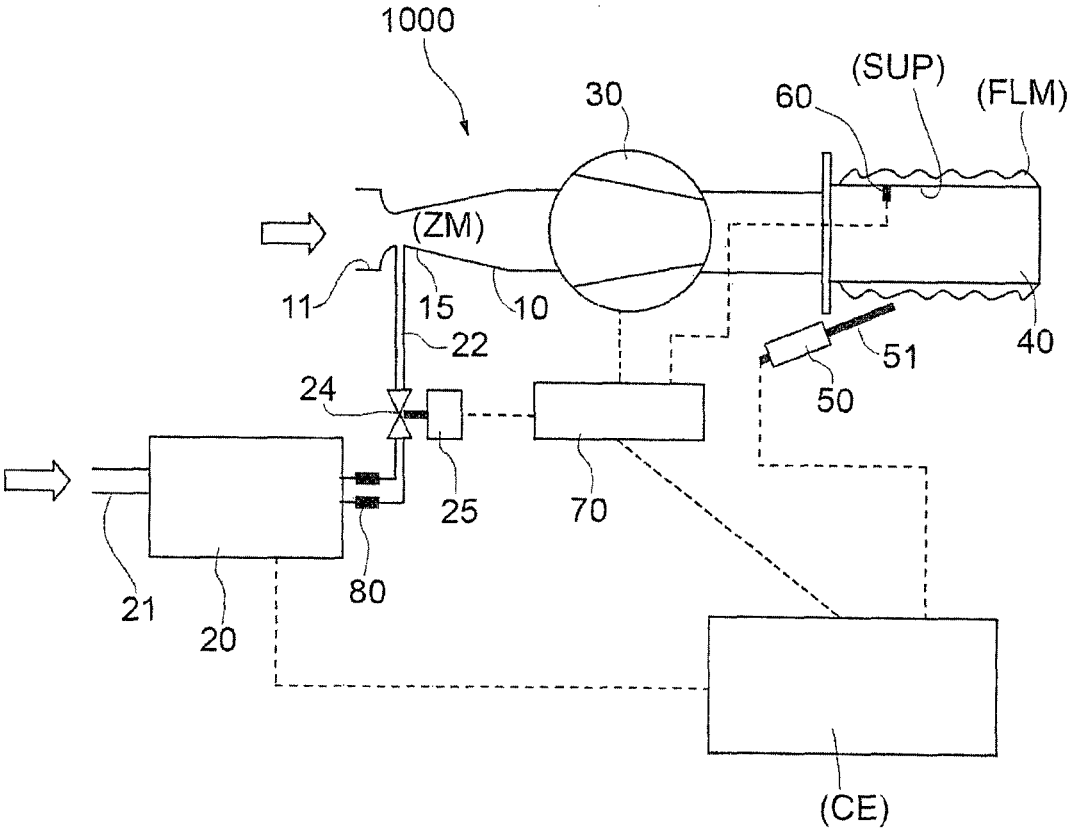
FIG. 2 shows an apparatus for adjusting and controlling the combustion, manufactured according to the principles of the present invention.

In FIG. 2, reference 1000 indicates in its whole an apparatus for adjusting and controlling the combustion made according to the teaching of the present invention.

Figure 1:
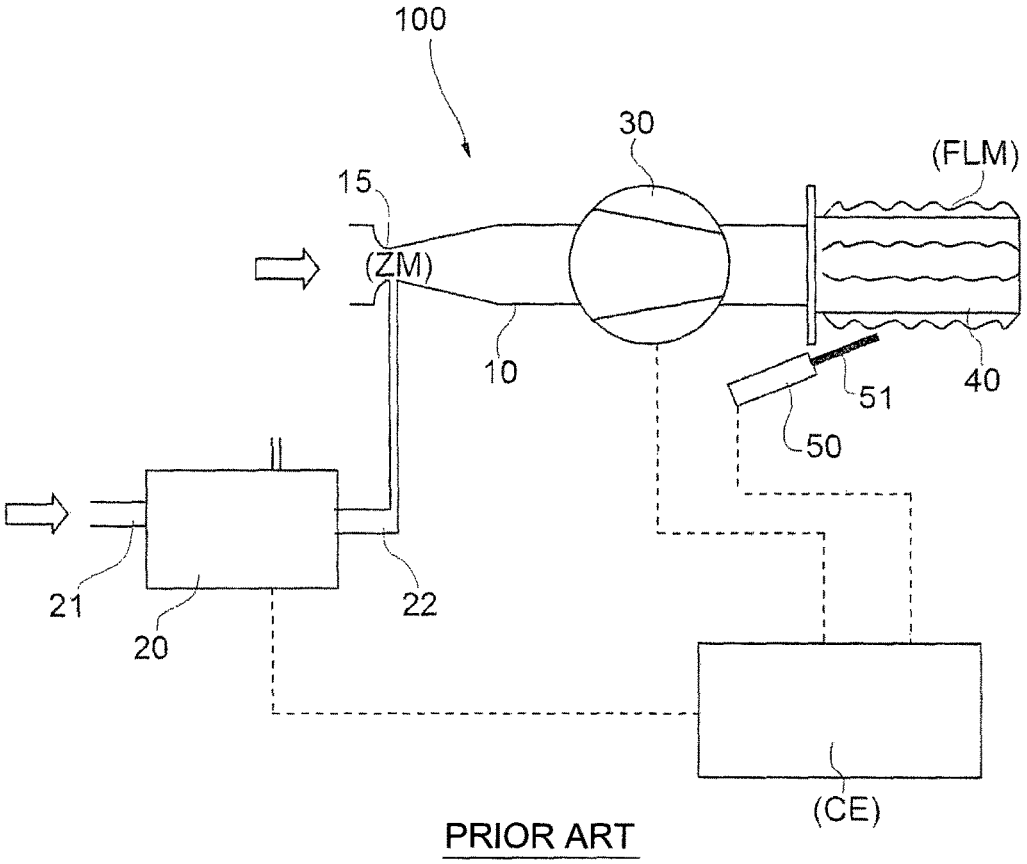
FIG. 1 shows a prior art embodiment of an apparatus for adjusting and controlling combustion.

The same references have been used in FIG. 2 for elements which were identical or similar to those illustrated in FIG. 1.

It is evident that most of the components are the same, and therefore they will not be described again.

The following structural elements were, however, added or changed in the apparatus 1000 illustrated in FIG. 2:

- a temperature probe 60 (typically, a thermocouple) arranged on the inner surface (SUP) of the perforated metal wall of burner 40, from which the flame propagates outwards; the temperature probe 60 is advantageously arranged in an area of the perforated duct around which the flame (FLM) propagates, and it is in such a position that it can detect increasingly high temperatures by decreasing the Pot power supplied by burner 40;
- the duct 22 is provided with a throttle valve 24 mechanically controlled by an actuator 25 which is in turn controlled by a special electronic card 70, physically separated from the electronic control unit (CE); and
- an interchangeable calibrated diaphragm 80, selected according to the gas family, which is indifferently arranged at the beginning, at the end or along the path of duct 22 for purposes which will be better explained below; the calibrated diaphragm 80 must be sized so that it operates the system under safe conditions even in case of failure of other components.

Possibly; the valve 24 and the related actuator 25 can be physically integrated in the gas valve 20 without affecting the adjustment and safety functions inherent to the gas valve 20.

Figure 3:
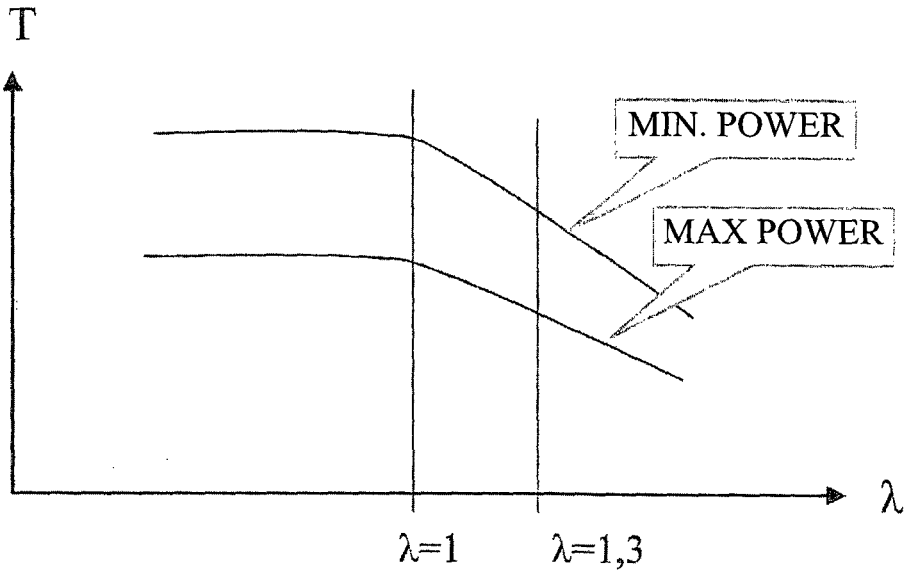
FIG. 3 shows some graphs showing how the values of the flame temperature vary depending on the λ value in the apparatus schematically shown in FIG. 3; the curves are parameterized depending on the burner operating power.

As also shown in FIG. 3, the electronic control unit (CE) is electronically connected to the gas valve 20, to the fan 30, to the safety spark plug 50 and to the electronic card 70.

In other words, the apparatus 1000 illustrated in FIG. 3 is based upon the use of traditional components, previously seen in FIG. 1, for a premix burner 40; namely

- the burner 40, on whose surface the combustion of the previously formed air/gas mixture is carried out;
- the fan 30, which determines the amount of air required for the perfect and complete gas combustion and, therefore, also determines the Pot power of the burner 40;
- a traditional pneumatic gas valve, in which the opening for the gas passage and the gas amount required from the valve derives from the depression generated by the Venturi mixer and, therefore, from the amount of air ventilated by the fan; and
- a throttle valve 24 controlled by an actuator 25 (preferably, but not necessarily, an electric actuator) which operates as described hereinafter.

In the present invention, and as shown in FIG. 3, the temperature values T measured in the burner 40, parameterized for each value of Pot power, are related to the values of the air/gas ratio λ.

In such a case, by decreasing the λ values, the detected temperature values T increase.

However, by decreasing the parameterized values of Pot power, the detected temperature values T increase though the λ values are the same (FIG. 3).

Furthermore, by varying the Pot power, the trend of the curves remains perfectly analogous.

In particular, FIG. 3 also shows that with λ values≤1.0, temperature values T, measured with a particular parameterized Pot power, remain constant.

For each of the curves illustrated in FIG. 3, and therefore for each Pot power value, it is never possible to obtain two identical temperature values when λ is more than or equal to 1.

This means that the electronic controller does not have to perform complex control operations to check whether, for a given fan speed (and therefore for a corresponding power), the burner is operating in excess or in defect of air.

Since (as already stated in the introduction) the optimal value of λ has been experimentally confirmed to be suitable to any kind of gas belonging to the same family, it must be noted that these temperature trends are not related to the kind of gas used, but only to the value of the power supplied by the burner.

Figure 4:
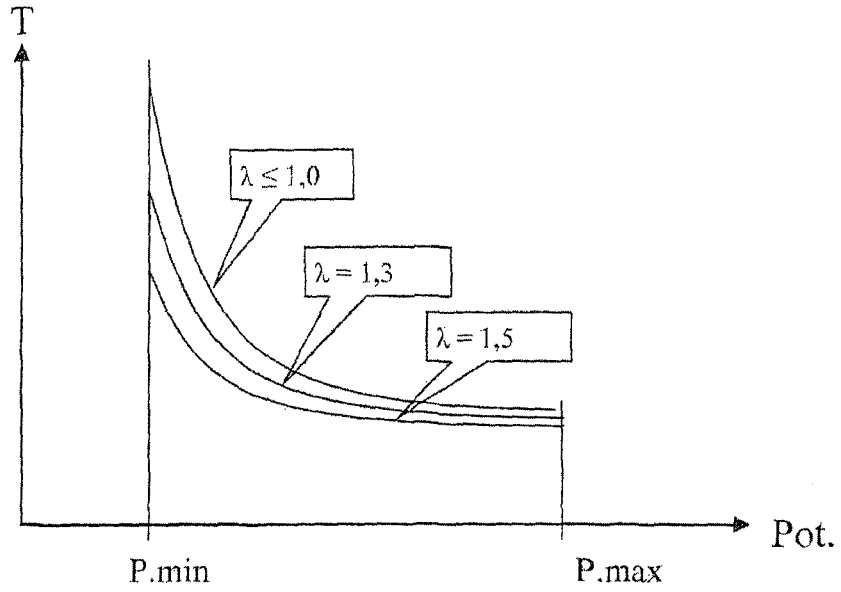
FIG. 4 shows some graphs showing how the temperature values detected by the probe 60 vary depending on the burner operating power; the curves are parameterized depending on the λ values.

Therefore, it has been experimentally verified that, as shown in FIG. 4, the temperature T, measured on the inner surface of the burner 40 in the immediate flame (FLM) area, maintains the same trend as the power values varies, translating downwards when the λ value increases and upwards when the λ decreases; but always with an upper limit curve corresponding to the value λ=1.0.

The fact that the temperature T of the flame (FLM) decreases by increasing the Pot power of burner 40 is due to the fact that for increasing the Pot thermal power of the burner, the flow rate of fan 30 and therefore of the air/gas mixture coming out of burner 40 must be increased; and this causes a removal of the flame front (FLM) from the outer cylindrical surface of burner 40 and its subsequent cooling.

Therefore, the following choices have been made in order to obtain an intrinsically safe system:

- the aforesaid calibrated diaphragm has been inserted on the gas line (either in the gas valve, at its output or at the input of the throttle; or even downstream of the throttle itself) so that, even with a completely open throttle and with gases having a higher Wi within the same group (the so called incomplete combustion gases), the excess air values are always sufficient to ensure CO emissions below the limit allowed by the rules;
- it has been used a traditional pneumatic gas valve, in which the opening for the gas passage and the gas amount required from the valve derives from the depression generated by the Venturi mixer and, therefore, from the amount of air sucked by the fan;
- the check on the presence of a flame is entrusted to the traditional detection system based on the detection of the passage of current occurring between the detection spark plug and the mass only in the presence of a flame;
- in case of a partially closed throttle, whatever the gas used, the values of excess air are so high that they cause the detachment of flame, thus activating the safety system seen in the preceding paragraph.

The safety of the system is therefore entrusted to safety devices traditionally present in premix burners (pneumatic gas valve and flame detection system) and to the size of the nozzle regulating the maximum gas flow.

Figure 5:
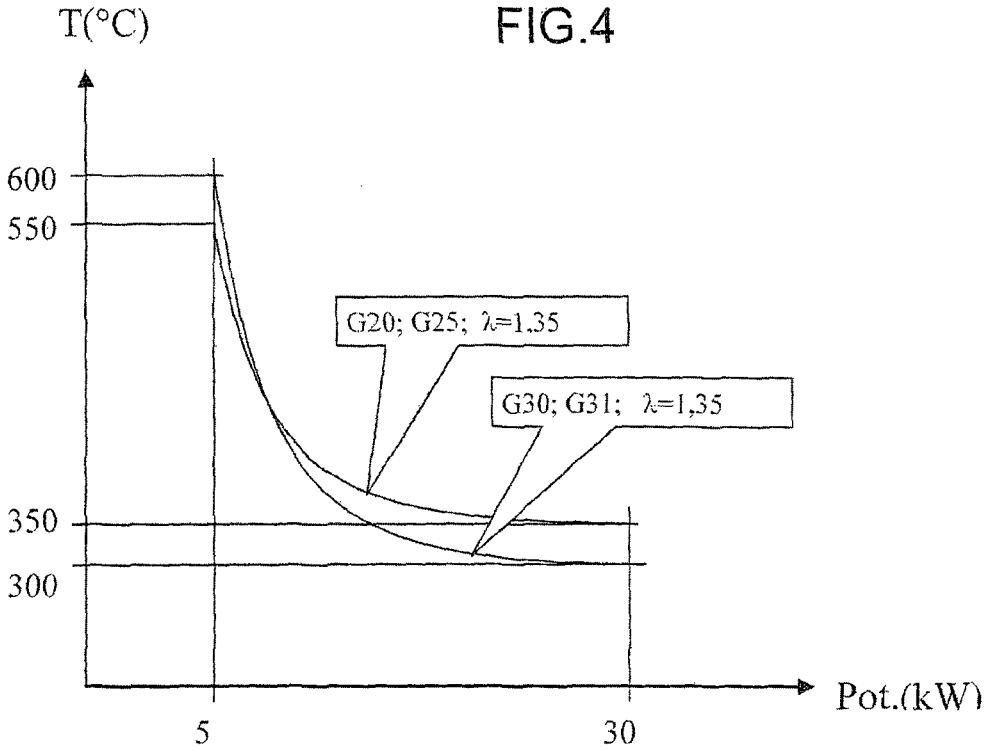
FIG. 5 shows some graphs to which reference will be made in order to explain the general operation of the apparatus of FIG. 3.

With a reference to FIG. 5, let us explain now the operating logic of the system.

For each of the two reference gas families, the second and the third one, an optimal reference curve of the temperature detected inside the burner has been set according to the supplied power.

As previously shown, each curve corresponds to a defined λ value which is optimal to obtain the best possible combustion with the reference gases of the two families.

In our case, the same λ values have been obtained:

for the second family: G20 and G25: λ=1.35;

for the third family: G30 and G31: λ=1.35.

Figure 6:
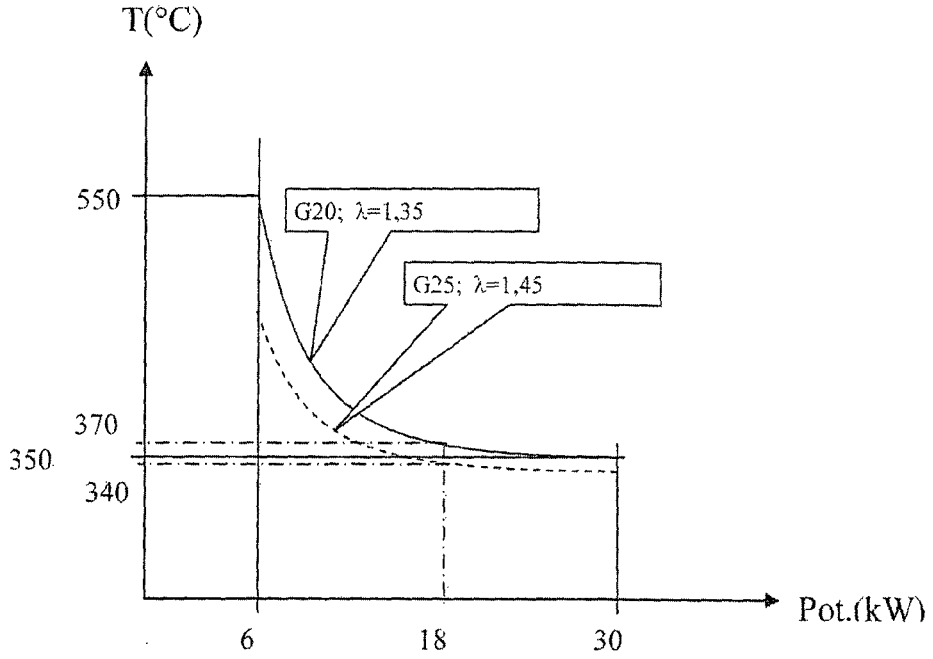
FIG. 6 shows some graphs to which reference will be made in order to explain the operation at full capacity of the apparatus of FIG. 3 by varying the kind of gas used.

In any case, it is possible to choose λ values different from the one indicated in the example reported in FIG. 6, or even λ values which are slightly different in the passage between the maximum and the minimum Pot power depending on specific needs such as, for instance, the production of a smaller mass of fumes or a further reduction of pollutants or a better ignition.

It has therefore been designed the aforesaid electronic card 70 shown in FIG. 2, which:

- measures the speed of the rotor of the fan, thus indirectly measuring the power supplied by the burner;
- measures the temperature of the burner inner wall; and
- acts on the actuator of the gas throttle valve in the supply duct so that the burner temperature reaches the predetermined value as quickly as possible, thus reaching the predetermined optimal λ value.

The speed and accuracy with which this value is reached are entrusted to a special control algorithm that allows, in a few seconds, to reach the stable desired value.

Operation at Full Capacity Varying the Kind of Gas Used (FIG. 6)

The burner 40 works, for instance, at the intermediate power of 18 kW with natural gas G20.

The fan 30 works at the intermediate air flow rate.

The Venturi mixer 15 generates an intermediate depression causing the opening of the shutter of the gas valve 20 in the intermediate position.

Under these conditions, the temperature detected by the temperature probe 60 within the burner 40 is 370° C. and the valve 24 is partially closed in such a position that it has the predetermined value of λ=1.35.

In fact, the electronic controller has measured the rotation speed of the rotor of the fan 30 and has actuated the valve 24 closing it enough to obtain the temperature corresponding to that speed.

By feeding gas G25 into the burner (gas having a 18% lower Wi than G20), in the absence of the apparatus 1000 object of the present invention, there would be an increase of the excess air, which would then become λ=1.45, with a subsequent temperature decrease to 340° C.

Vice versa, when the temperature probe 60 detects a temperature decrease, the electronic controller activates the opening throttle, thus decreasing the air/gas ratio until it obtains again a temperature of 370° C. within the burner 40.

In this way, automatically and consequently, the λ value is restored to the predetermined value of λ=1.35.

A perfectly analogous operation, but in the opposite direction, is obtained by introducing gas G21 having a 9% higher Wi than G20 instead of natural gas G20.

The calibrated diaphragm 80 arranged between the gas valve 20 and the valve 24 is sized so that λ values higher than 1.0 (therefore always with a suitable amount of excess air) are obtained with a completely open throttle and with flame return limit gas G21, in order to produce CO emissions below the limit allowed by the rules.

If, for any reason, the valve 24 were blocked in a completely open position, the maximum emissions would therefore always be within the limit allowed by the rules.

If, on the other hand, the valve 24 were blocked in a completely closed position, the gas would not reach the Venturi mixer; therefore no combustion would occur and the electronic controller, detecting no flame, would close the safety shutter of the gas valve.

Figure 7:
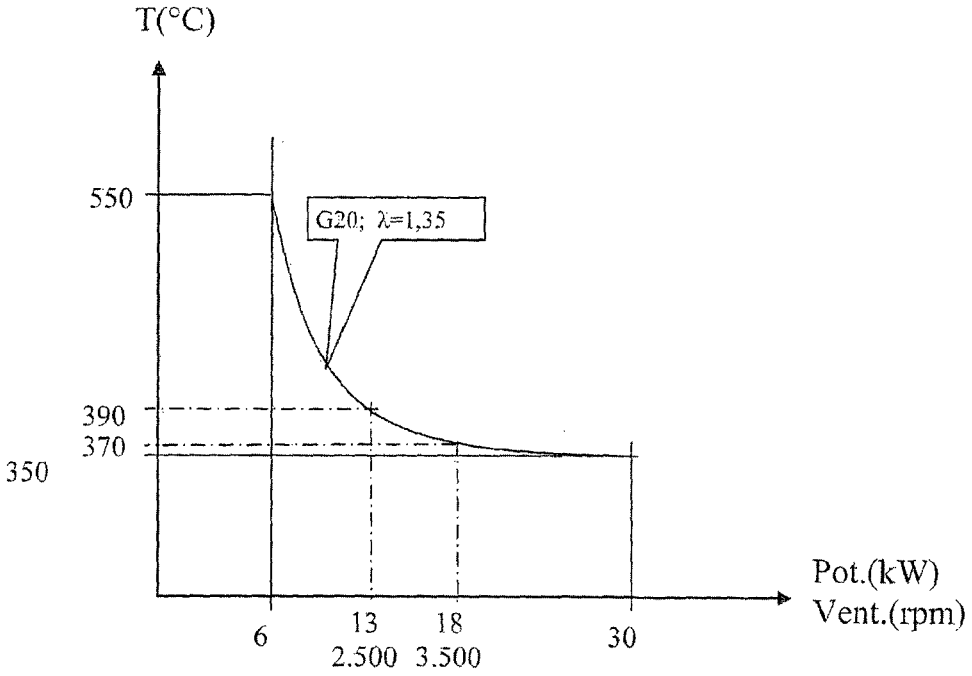
FIG. 7 shows some graphs to which reference will be made in order to explain the operation of the apparatus of FIG. 3 by varying the power supplied by the burner.

Variation of the Power Supplied by the Burner (FIG. 7)

The burner 40, for instance, works at the intermediate power of 18 kW with natural gas G20.

The starting reference conditions are therefore the same as previously seen.

They correspond to a speed of the fan 30 equal to, for instance, 3500 rpm.

By decreasing the speed of the fan 30, for instance, to 2500 rpm in order to decrease the Pot power, in the absence of the apparatus 1000 object of the present invention, there would be a proportional decrease of the amount of gas sucked by the Venturi mixer 15 without any variation in the air/gas ratio.

At the same time there would be an increase of the temperature within the burner 40 from 370° C. to 390° C.

Vice versa, with the apparatus 1000 there is a reduction of the speed of the fan 30, the system identifies the aforesaid reference temperature value of 390° C. and actuates, if necessary, the valve 24 by slightly opening the gas passage in order to reach more quickly that value; then it comes back to the previous position behaving to all effects like a diaphragm having a constant section.

In such a way, after a transitional period of a few seconds, the λ value comes back to the predetermined λ=1.35.

There is a perfectly analogous operation, but in the opposite direction, by increasing the speed of the fan 30, for example, from 3500 rpm to 4500 rpm.

In this specific case, the electronic card 70 detects this speed increase, identifies the predetermined reference temperature value of 360° C., and actuates, if necessary, the valve 24, slightly closing the gas passage in order to reach more quickly that value; then it comes back to the previous position behaving to all effects like a diaphragm having a constant section.

In this way, after a transitional period of a few seconds, the λ value comes back to the predetermined λ=1.35.

In short, the present invention concerns an apparatus, a kit and a method relating to the combustion of a fuel gas.

The first object of the present invention is an apparatus for adjusting and controlling the combustion in a fuel gas burner comprising the following mutually integrated components:

- a comburent gas/fuel gas mixing pipe provided with a Venturi mixer in correspondence of which a fuel gas supply duct opens;
- means for adjusting the flow rate of fuel gas;
- ventilation means, at least partially housed in said mixing pipe;
- combustion means arranged downstream of said ventilation means;
- a safety system based upon the detection of the flame present in said combustion means; and
- an electronic control unit of devices belonging to the apparatus;

the apparatus is characterized in that it further comprises:

- a temperature probe arranged on the inner surface of combustion means;
- a valve for adjusting the fuel gas flow rate in the duct; said valve belonging to said control means and being mechanically controlled by an actuator; and
- an electronic card, electronically connected to said probe, to said ventilation means and to actuating means for adjusting the opening of said valve.

The second object of the present invention is an auxiliary kit of an apparatus for adjusting and controlling the combustion in a fuel gas burner; said kit being characterized in that it comprises the following components:

- a temperature probe which can be arranged on the inner surface of a perforated metal wall of the burner, wall from which a flame propagates outwards; and
- a valve mechanically controlled by an actuator which is, in turn, controlled by a relating electronic card.

The third object of the present invention is a method for adjusting and controlling the combustion in a fuel gas burner; method comprising the following steps:

(f1) measuring the speed of ventilation means suitable to send a comburent gas to said combustion means;

(f2) measuring the temperature of said combustion means; and (f3) acting on the opening of fuel gas supply means to said combustion means; said method being characterized in that it adjusts the combustion in order to maintain the temperature of said combustion means to predetermined values, experimentally defined, usually increasing with decreasing speed of said ventilation means; the predetermined temperature values of said combustion means being independent of the kind of gas used and being optimal for the combustion for each speed value of said ventilation means.

The main advantage of the apparatus object of the present invention consists in that it operates premix burners with the same air/gas ratio which is optimal for any kind of gas belonging to the same family and at any power comprised in its working range, thus obtaining an optimal combustion (namely with a minimal emission of pollutants and with a maximum guarantee of burner ignition) and maintaining the safety and the reliability resulting from the use of traditional safety systems used in the prior art (pneumatic gas valve, air/gas Venturi mixer and flame ionization detector).

The invention claimed is:

1. An apparatus for adjusting and controlling the combustion in a fuel gas burner comprising the following mutually integrated components:

- a comburent gas/fuel gas mixing pipe provided with a Venturi mixer in correspondence of which a fuel gas supply duct opens;
- a pneumatic gas valve feeding gas in an amount corresponding to the depression generated downstream of the valve by the Venturi mixer and, therefore, corresponding to the amount of air passing through it;
- ventilation means, at least partially housed in said mixing pipe;
- combustion means arranged downstream of said ventilation means;
- a safety system based upon the detection of the flame present in said combustion means; and
- an electronic control unit for controlling the pneumatic gas valve and the ventilation means;
- said apparatus being characterized in that it further comprises:
  - a temperature probe arranged on the inner surface of combustion means;
  - a throttle valve for adjusting the fuel gas flow rate in the duct;
  - an interchangeable calibrated diaphragm arranged along said fuel gas supply duct to said combustion means; wherein a size of said calibrated diaphragm is selected in accordance with the fuel gas and prevents said combustion means from working with an excess gas also in case of failure of other components; and
  - an electronic card, separate from the electronic control unit that monitors a temperature sensed by the temperature probe and a working parameter associated with the ventilation means and adjusts the throttle valve to maintain a temperature at the inner surface at a predetermined value.

2. The apparatus according to claim 1, characterized in that said electronic card is electronically connected to said electronic control unit.

3. The apparatus according to claim 1, wherein the ventilation means is a fan and the working parameter is a rotational speed of the fan.

4. The apparatus according to claim 2, characterized in that said electronic control unit comprises electronic means performing safety functions by means of a flame detection device; said electronic control unit further comprising electronic means to control the operation of said ventilation means through said electronic card.

5. The apparatus according to claim 1, wherein said temperature probe is advantageously arranged on the inner surface of a perforated duct belonging to said combustion means from which the flame propagates, and in such a position that it can detect increasingly high temperatures by decreasing the power supplied by said combustion means and by decreasing the air/gas ratio.

6. The apparatus according to claim 1, characterized in that the temperature probe, the electronic card, the throttle valve and said calibrated diaphragm comprise a retrofit kit.

7. The apparatus according to claim 1, characterized in that said throttle valve and said actuating means are physically integrated in a gas valve.

8. The apparatus according to claim 1, characterized in that said electronic card is physically integrated, but functionally separated, in said electronic control unit, thus leaving unaltered the control function of the flame presence performed by said electronic control unit.

* * * * *